US012259135B2

(12) United States Patent
Hu

(10) Patent No.: US 12,259,135 B2
(45) Date of Patent: Mar. 25, 2025

(54) COMBUSTOR WITH FUEL AND AIR MIXING PLENUM

(71) Applicant: Pratt & Whitney Canada Corp., Longueuil (CA)

(72) Inventor: Tin Cheung John Hu, Markham (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/130,683

(22) Filed: Apr. 4, 2023

(65) Prior Publication Data

US 2024/0263790 A1 Aug. 8, 2024

Related U.S. Application Data

(60) Provisional application No. 63/442,889, filed on Feb. 2, 2023.

(51) Int. Cl.

| | |
|---|---|
| ***F23R 3/28*** | (2006.01) |
| ***F23R 3/02*** | (2006.01) |
| ***F23R 3/04*** | (2006.01) |
| ***F23R 3/16*** | (2006.01) |
| ***F23R 3/30*** | (2006.01) |
| ***F23R 3/34*** | (2006.01) |

(52) U.S. Cl.

CPC ..... *F23R 3/286* (2013.01); *F23R 3/02* (2013.01); *F23R 3/04* (2013.01); *F23R 3/045* (2013.01); *F23R 3/16* (2013.01); *F23R 3/30* (2013.01); *F23R 3/34* (2013.01); *F23R 3/346* (2013.01)

(58) Field of Classification Search

CPC .... F23R 3/002; F23R 3/02; F23R 3/04; F23R 3/045; F23R 3/16; F23R 3/286; F23R 3/30; F23R 3/34; F23R 3/346

See application file for complete search history.

(56) References Cited

U.S. PATENT DOCUMENTS

| | | | | |
|---|---|---|---|---|
| 4,578,946 | A | 4/1986 | Readman et al. | |
| 5,667,374 | A * | 9/1997 | Nutcher | F23D 14/14 431/328 |
| 5,836,289 | A | 11/1998 | Thring | |
| 6,062,848 | A | 5/2000 | Lifshits | |
| 6,145,496 | A | 11/2000 | Pace et al. | |

(Continued)

FOREIGN PATENT DOCUMENTS

| | | |
|---|---|---|
| CN | 101220955 | 7/2008 |
| CN | 206113000 | 4/2017 |

(Continued)

OTHER PUBLICATIONS

European Search Report for EP Application No. 24155612.5 dated Jun. 5, 2024.

*Primary Examiner* — Kyle Robert Thomas

(74) *Attorney, Agent, or Firm* — Carlson, Gaskey & Olds, P.C.

(57) ABSTRACT

A combustor includes a liner and an air fuel mixing body in a wall of the liner. A fuel supply passage provides fuel into the mixing body. The fuel then is injected through radial distribution passages into a mixing plenum. The mixing plenum receives a cellular material. Air supply passages deliver air into the mixing plenum. Downstream extending passages lead from the mixing plenum to an inner face of the mixing body for delivery of mixed fuel and air into a combustion chamber.

20 Claims, 6 Drawing Sheets

(56) References Cited

U.S. PATENT DOCUMENTS

| | | | | |
|---|---|---|---|---|
| 6,267,585 | B1 | 7/2001 | Suttrop | |
| 6,834,504 | B2 * | 12/2004 | Griffin | F23M 20/005 60/737 |
| 7,017,329 | B2 | 3/2006 | Farhangi et al. | |
| 7,832,212 | B2 | 11/2010 | Bunker | |
| 7,870,736 | B2 | 1/2011 | Homitz et al. | |
| 7,891,191 | B2 * | 2/2011 | Yoshida | F23D 11/104 60/39.23 |
| 8,266,911 | B2 | 9/2012 | Evulet | |
| 8,413,445 | B2 | 4/2013 | Poyyapakkam | |
| 8,539,773 | B2 | 9/2013 | Ziminsky et al. | |
| 8,661,779 | B2 | 3/2014 | Laster et al. | |
| 8,858,224 | B2 * | 10/2014 | Mungas | F23D 14/82 60/39.1 |
| 8,893,500 | B2 | 11/2014 | Oskam | |
| 9,322,559 | B2 * | 4/2016 | Pinson | F23R 3/286 |
| 9,587,562 | B2 * | 3/2017 | Ostebee | F02C 3/14 |
| 9,771,869 | B2 | 9/2017 | Li et al. | |
| 9,951,956 | B2 * | 4/2018 | Valeev | F23R 3/286 |
| 9,976,522 | B2 | 5/2018 | Patel et al. | |
| 10,082,294 | B2 | 9/2018 | Laster et al. | |
| 10,267,522 | B2 | 4/2019 | Ciani et al. | |
| 10,502,425 | B2 | 12/2019 | Boardman et al. | |
| 10,704,786 | B2 | 7/2020 | Laster et al. | |
| 10,865,989 | B2 | 12/2020 | Sadasivuni | |
| 10,941,940 | B2 | 3/2021 | Bulat et al. | |
| 11,067,280 | B2 | 7/2021 | Boardman et al. | |
| 11,525,403 | B2 | 12/2022 | Morenko et al. | |
| 2002/0078690 | A1 | 6/2002 | Stuttaford et al. | |
| 2011/0076628 | A1 | 3/2011 | Miura et al. | |
| 2011/0185703 | A1 | 8/2011 | Dodo et al. | |
| 2012/0227411 | A1 | 9/2012 | Carroni et al. | |
| 2013/0199190 | A1 | 8/2013 | Uhm et al. | |
| 2017/0211807 | A1 | 7/2017 | Graichen | |
| 2017/0227224 | A1 | 8/2017 | Oskam et al. | |
| 2017/0299188 | A1 | 10/2017 | Horikawa et al. | |
| 2017/0307210 | A1 | 10/2017 | Hirano et al. | |
| 2021/0095599 | A1 * | 4/2021 | Asai | F02C 9/263 |
| 2021/0172413 | A1 | 6/2021 | Snyder | |
| 2021/0180518 | A1 | 6/2021 | Koganezawa et al. | |
| 2022/0178540 | A1 | 6/2022 | Chandra et al. | |
| 2022/0333781 | A1 | 10/2022 | Chandra et al. | |
| 2022/0356845 | A1 | 11/2022 | Morenko et al. | |

FOREIGN PATENT DOCUMENTS

| | | |
|---|---|---|
| EP | 1923637 | 5/2008 |
| JP | 5188238 B2 | 4/2013 |
| JP | 2013108667 | 6/2013 |
| JP | 5538113 | 7/2014 |
| JP | 5926635 | 5/2016 |
| WO | 2016051756 | 4/2016 |
| WO | 2020259919 | 12/2020 |

* cited by examiner

COMBUSTOR WITH FUEL AND AIR MIXING PLENUM

CROSS-REFERENCE TO RELATED APPLICATIONS

This application claims priority to U.S. Provisional Application No. 63/442,889 filed on Feb. 2, 2023.

BACKGROUND

This application relates to mixing structure for mixing fuel and air in a combustor of a gas turbine engine.

Gas turbine engines are known, and typically include a compressor delivering compressed air into a combustor. Compressed air is mixed with fuel and ignited. Products of the combustion pass downstream over turbine rotors, driving them to rotate. The turbine rotors in turn rotate a compressor rotor and a propulsor rotor such as a fan or propeller.

Historically, liquid aviation fuel has been utilized with gas turbine engines, especially for aircraft applications. More recently it has been proposed to utilize gaseous fuel for combustion, such as hydrogen ($H_2$).

SUMMARY

A combustor includes a liner and an air fuel mixing body in a wall of the liner. A fuel supply passage provides fuel into the mixing body. The fuel then is injected through radial distribution passages into a mixing plenum. The mixing plenum receives a cellular material. Air supply passages deliver air into the mixing plenum. Downstream extending passages lead from the mixing plenum to an inner face of the mixing body for delivery of mixed fuel and air into a combustion chamber.

These and other features will be best understood from the following drawings and specification, the following is a brief description.

DETAILED DESCRIPTION

Figure 1:
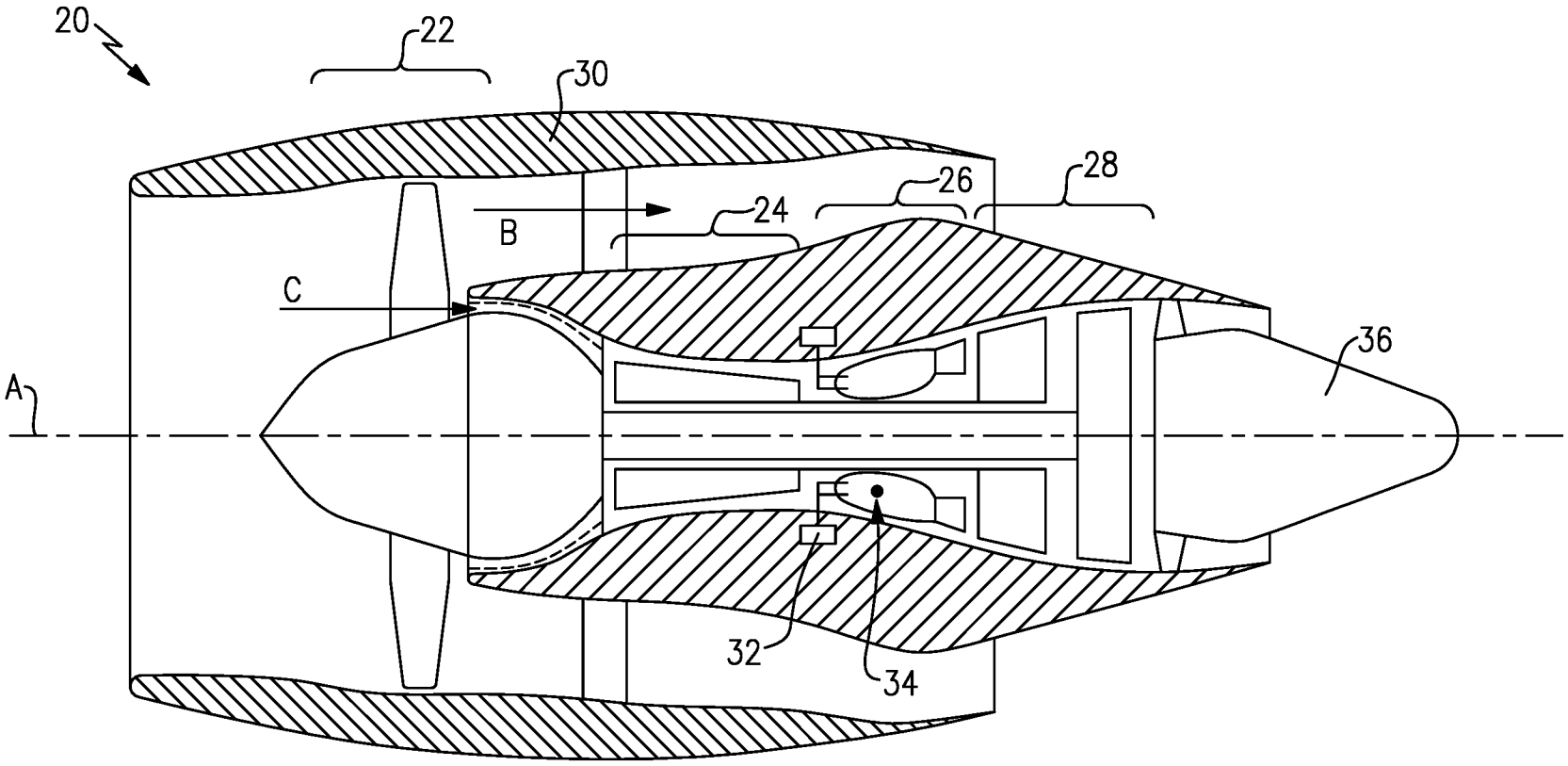
FIG. 1 schematically shows a gas turbine engine.

FIG. 1 schematically illustrates a gas turbine engine 20. The example gas turbine engine 20 is a turbofan that generally incorporates a fan section 22, a compressor section 24, a combustor section 26 and a turbine section 28. The fan section 22 drives air along a bypass flow path B in a bypass duct defined within a nacelle 30. The turbine engine 20 intakes air along a core flow path C into the compressor section 24 for compression and communication into the combustor section 26. In the combustor section 26, the compressed air is mixed with fuel from a fuel system 32 and ignited by igniter 34 to generate an exhaust gas flow that expands through the turbine section 28 and is exhausted through exhaust nozzle 36. Although depicted as a turbofan turbine engine in the disclosed non-limiting embodiment, it should be understood that the concepts described herein are not limited to use with turbofans as the teachings may be applied to other types of turbine engines. As one example, rather than having the propulsor be an enclosed fan, the propulsor may be an open propeller.

A gas turbine engine as disclosed in this application will utilize a gaseous fuel for combustion, such as hydrogen ($H_2$). Challenges are faced by the use of gaseous fuel, such as hydrogen, and in particular combustor structure which might be appropriate for aviation fuel may not be as applicable for gaseous fuel, especially hydrogen as a fuel.

One challenge when utilizing gaseous fuel, such as hydrogen, is that it is in a gaseous state and more readily flammable than aviation fuel. This could raise challenges with burn back if ignitions starts too close to the fuel feed.

Figure 2B:
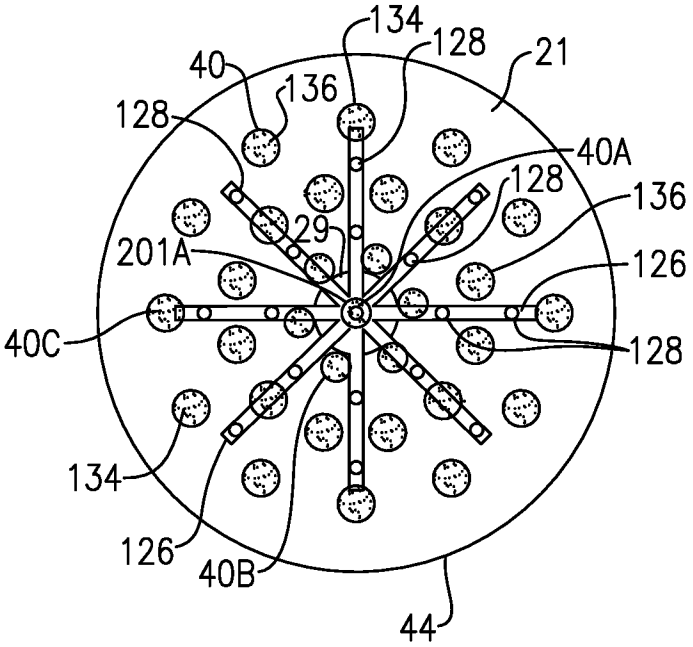
FIG. 2B is an end view of the FIG. 2A embodiment.
Figure 2A:
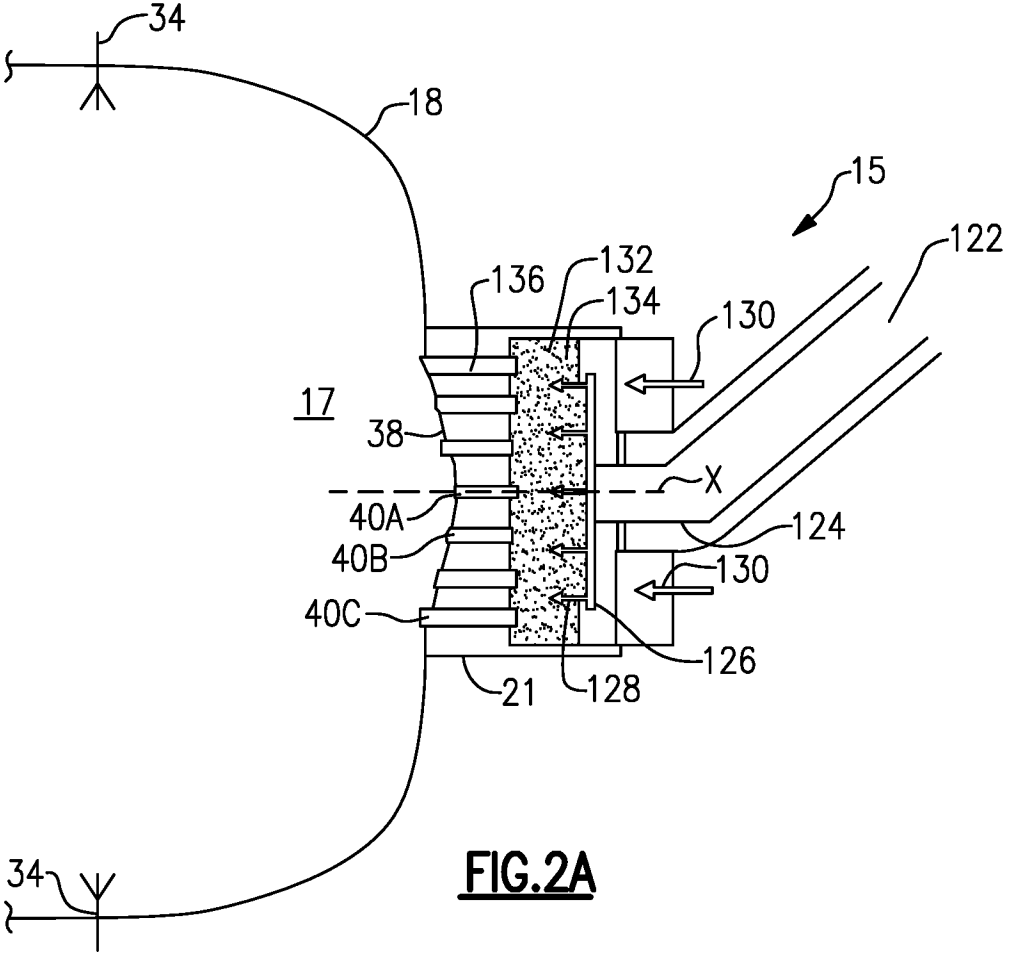
FIG. 2A shows a first embodiment combustor.

A combustor 15 is illustrated in FIG. 2A and has liner 18 (partially shown) and igniters 34, all shown schematically. A mixing body 21 is secured to an end of liner 18.

Fuel is injected through a feed 122 to a central fuel supply passage 124 having a center axis X. Passage 124 communicates with a plurality of radial distribution passages 126. That is passages 126 extend radially relative to axis X. The radial distribution passages 126 have a plurality of injection ports 128.

The fuel is injected from ports 128 into a mixing plenum 132 which is filled with an open cellular material 134. In one embodiment, the open cellular material may be a metal foam, and in particular may be Inconel®. Inconel® is a trademark owned by Special Metals Corporation.

The use of the cellular structure in the mixing chamber acts as a flame arrester and improves uniform mixing of the fuel and air. In embodiments the fuel is a gaseous fuel, such as hydrogen ("$H_2$").

Air is also delivered into the mixing plenum 132 through air inlets 130. Air pressure needs to be higher than the incoming hydrogen fuel pressure to avoid backflow of the fuel mixture out of the air inlet ports.

Downstream of the plenum 132 the mixed fuel and air enters a plurality of extending passages 136 which extend downstream of the plenum 132, and which do not receive the cellular structure. The extending passages 136 reaches an inner end face 38 of the mixing body 21, and deliver mixed fuel and air into a combustion chamber 17.

As shown, the end face 38 is not perpendicular to an axis X of the passage 124, nor to a central axis of the associated gas turbine engine. The outlets 40A closer to the center axis X of the central fuel supply passage 124 extend for a lesser distance downstream of the plenum 132 than do outlets 40B spaced further from the axis X. Outlets 40 at positions most spaced from the axis X of the central fuel supply passage 124 extend even further. The non-planar end-face of the fuel nozzle provides a harboring effect for the flame at the center of the nozzle. This will be beneficial for ignition and flame stability.

As shown in FIG. 2B, an outer periphery 44 of the body 21 may be cylindrical, although other shapes may be used. It should be understood there may be a plurality of circumferentially spaced mixing bodies 21 spaced across a circumference of the liner 18.

As can be seen, the fuel enters the central fuel supply passage 124 and communicates outwardly into the radial distribution passages 126. The injection ports 128 inject fuel into the plenum (only shown behind openings 40 in this Figure) and the fuel is mixed with the air. The view of FIG. 2B is generally to the left of FIG. 2A, looking into the openings 40, and thus one can see a cellular material 134 in the plenum 132. As is clear, the injection ports 128 are offset from the downstream extending passage portions 136. This also improves mixing within the plenum 132.

Figure 2C:
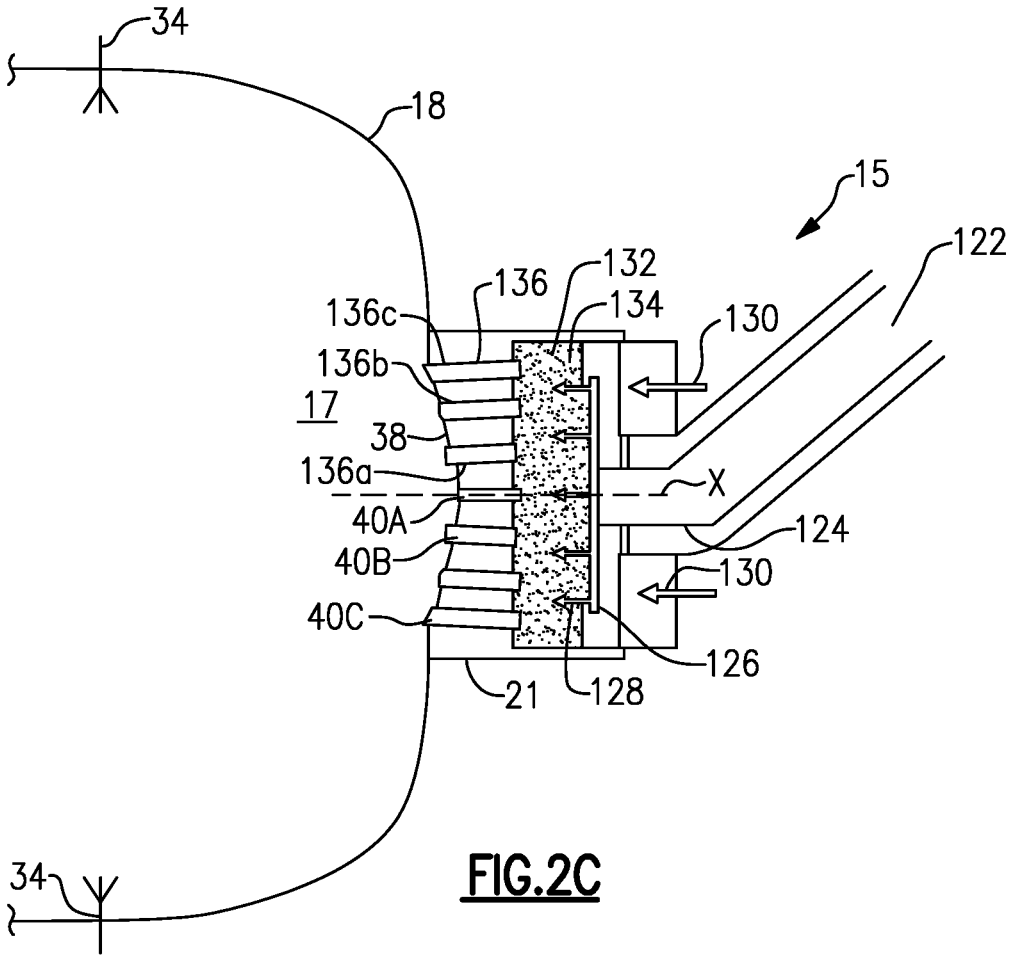
FIG. 2C shows a modification to FIG. 2A.

The mixture outlet passages 136*a*, 136*b* and 136*c* may extend with a radial component to further enhance the ignition and flame stability capabilities, see FIG. 2C.

Figures 3A, 3B:
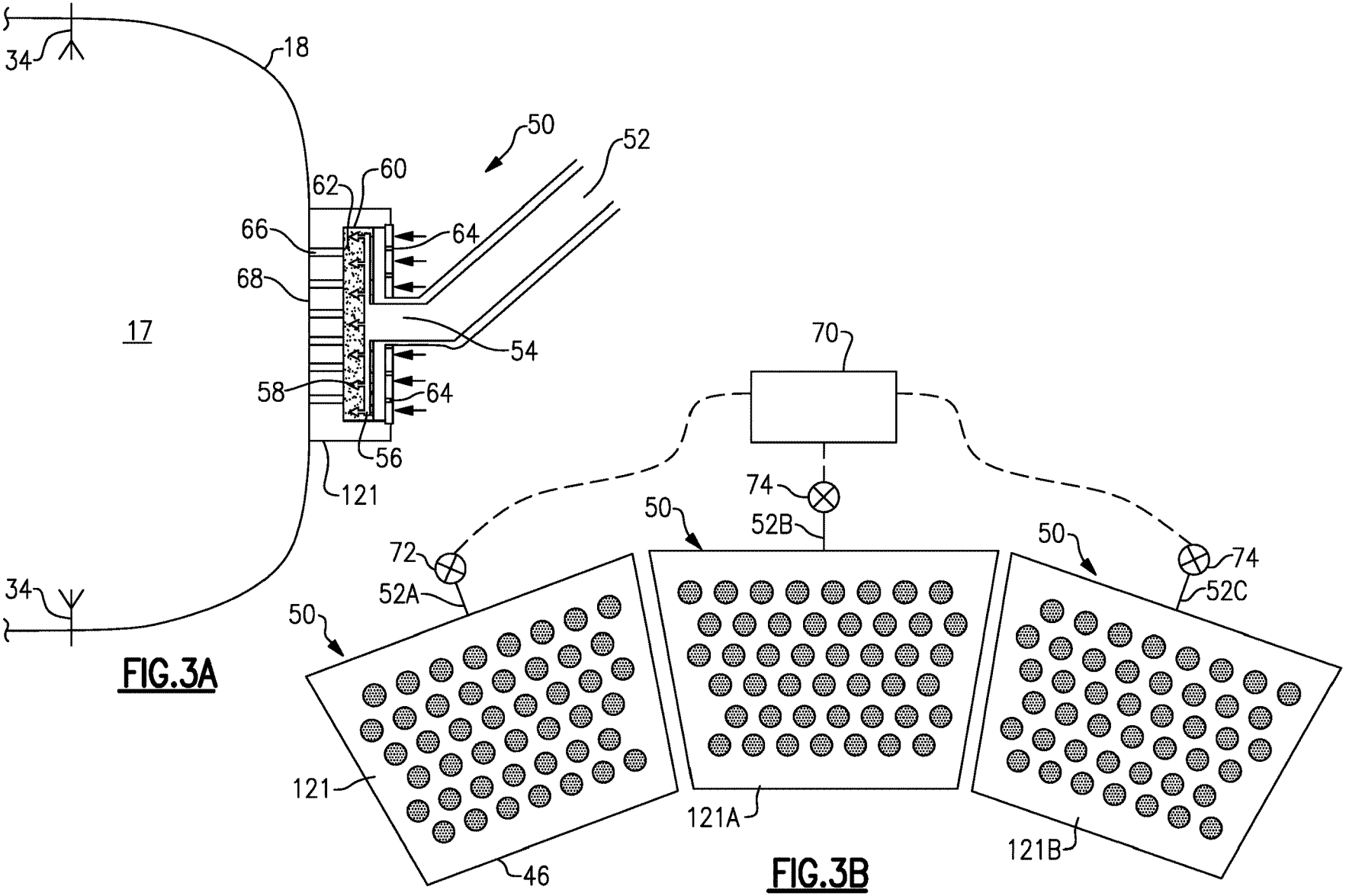
FIG. 3A shows a second embodiment combustor.
FIG. 3B shows another feature in the FIG. 3A embodiment.

FIG. 3A shows an embodiment 50 having a fuel supply 52 leading to central fuel supply passage 54 and into a plurality of radial distribution passages 56 in a mixing body 121. Radial distribution passages 56 each communicate with a plurality of injection ports 58 injecting fuel into a mixing plenum 60 receiving cellular material 62.

A plurality of openings 64 allow air into the mixing body 121, and then into the mixing plenum 60. Extending passages 66 extend downstream of the plenum 60 and do not receive cellular material. An inner face 68 of this embodiment is generally perpendicular to a central axis of the supply passage 54, and to a rotational axis of the engine.

FIG. 3B shows that an outer periphery of the bodies 121 may be polygonal. Alternatively, they may be other shapes, say cylindrical. Valves 72 and 74 are associated with a plurality of mixing bodies 121. As shown, lines 52A, 52B and 52C communicates fuel into each of the mixing bodies 121.

Control 70 may control the valves 72 and 74 such that valve 72 is part of a primary fuel supply which delivers fuel as a pilot and may be utilized for lower fuel flow operation such as starting. The valves 74 may be closed when the valve 72 is opened during this pilot operation. At higher fuel flow times the valves 74 may be open such that the fuel supply line 52B and 52C supply the fuel to mixing bodies 121A and 121B as a secondary fuel supply.

Control 70 controls valves 72 and 74 associated with the circumferentially spaced mixing bodies 121, 121A and 121B. The control 70 selectively opens or closes the valves 72 and 74 to deliver fuel into at least one of the plurality of circumferentially spaced mixing bodies, or block fuel flow into at least one of the mixing bodies 121, 121A, 121B. There is a primary fuel supply and a secondary fuel supply with at least some of the mixing bodies not receiving the fuel when the primary fuel supply is ongoing.

Figure 4A:
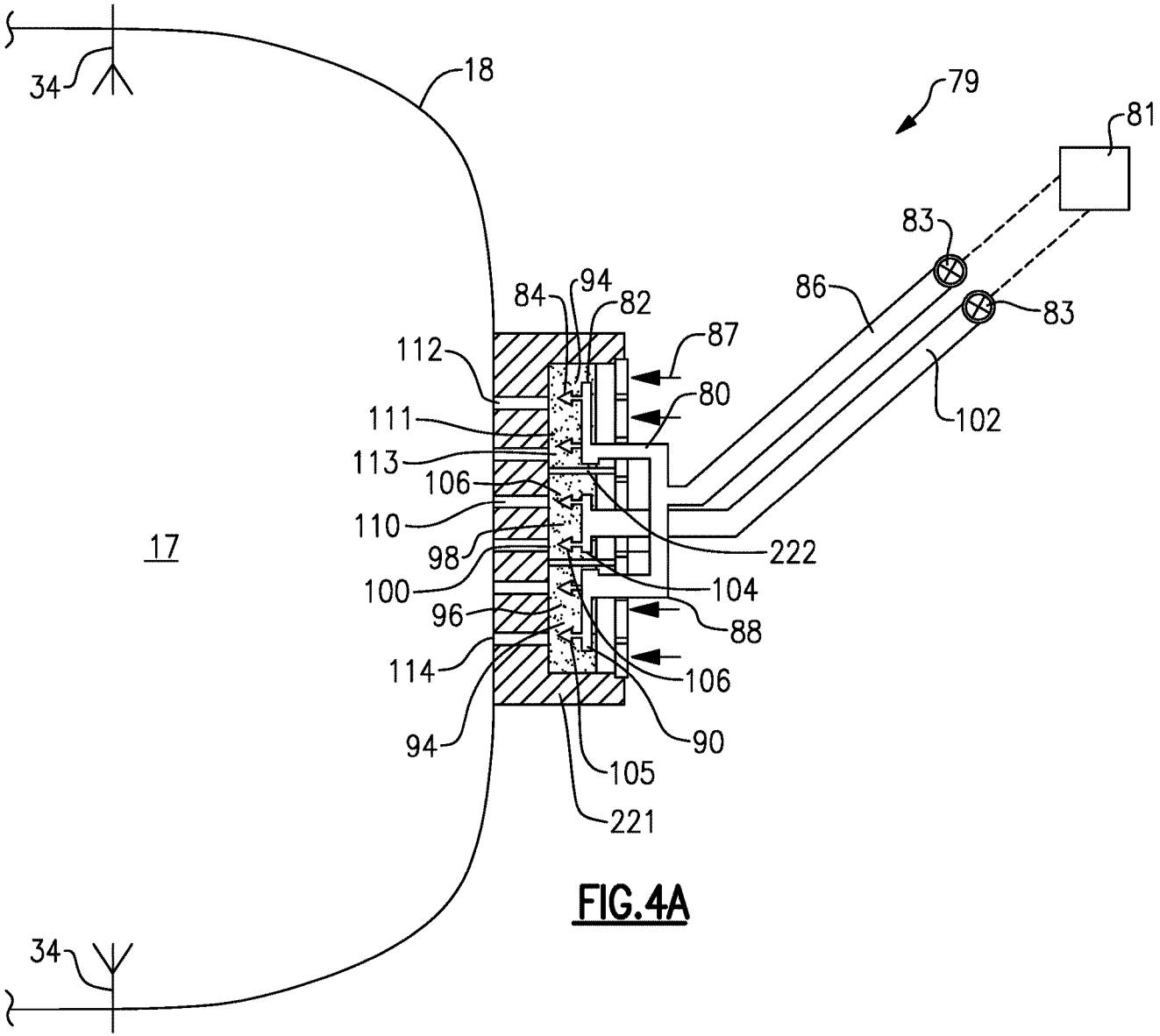
FIG. 4A shows yet another embodiment combustor.

FIG. 4A shows yet another embodiment 79 having a control 81 controlling a plurality of valves 83. A first fuel supply 86 may be operated in conjunction with valve 83 to be the secondary feed. Supply 86 extends to a forward fuel supply lines 80 which communicates with radial distribution passages 82 that inject fuel to openings 84 into plenum 111 having cellular material 94. Air enters mixing body 221 through openings 87. The air and fuel are mixed within the plenum 111 and then delivered into extending passages 112.

Another branch off of the secondary fuel supply line 86 reaches its own radially distribution passages 90 and then reaches injection ports 105 into plenum 96 having cellular material 94. This plenum 96 communicates with extending passages 114 leading towards the combustion chamber 17.

A primary feed 102 operates in conjunction with its valve 83 to supply fuel into a mixing plenum 98. Wall 222 separates plenums 111 and 98. The primary fuel reaches radial distribution passages 104 and injection ports 106. Extending passages 110 extend from the plenum 98 into the combustor chamber 17.

The mixing body 221 includes two of the fuel supply passages 86/102 each associated with a valve 83 controlled by a control 81. One of the fuel supply passages is operated in conjunction with the associated valve 81 as a primary fuel supply and a second of the two fuel supply passages is operated in conjunction with the associated valve 81 as a secondary fuel supply.

One of the first and second fuel supply passages has its mixing plenum radially spaced from the mixing plenum associated with another of the fuel supply passages relative to a central axis of the liner.

Figure 4B:
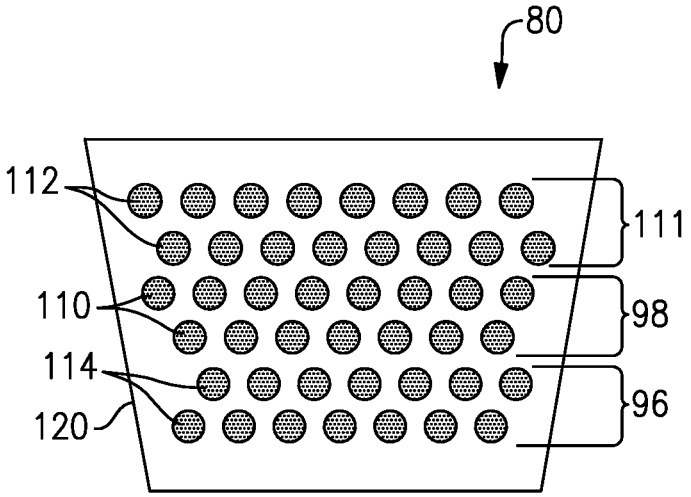
FIG. 4B shows a detail of the FIG. 4A embodiment.

As shown in FIG. 4B, the outer periphery 120 of the mixing body 221 is polygonal, but may be cylindrical. The location of the extending passage portions 112, 110 and 114 is illustrated.

The relative location of plenums 111, 98 and 96 is also shown. Plenum 111 are radially spaced from plenum 98, while plenum 98 is radially spaced from plenum 96 relative to a central axis of the engine.

Injection ports 128/58/84/106 and 105 are shown as arrows but would simply be ports in their respective radial distribution passages.

Notably, for purposes of this application the term "radially" should not be interpreted to mean directly radially. Instead, it is intended to make clear the passages extend along a direction with a component in a radial direction.

A combustor 15/50/79 under this disclosure could be said to include a liner 18 and an air and fuel mixing body 21/121/221 in a wall of the liner. A fuel supply passage provides fuel into the mixing body. The fuel is then being injected from radial distribution passages 126/56/82/90/104 into a mixing plenum. The mixing plenum receives a cellular material. Air supply passages deliver air into the mixing plenum 132/60/111/98/96. Downstream extending passages 136/66/110/112/114 lead from the mixing plenum to an inner face of the mixing body for delivery of mixed fuel and air into a combustion chamber 17.

In another embodiment according to the previous embodiment, there are a plurality of circumferentially spaced ones of the mixing bodies.

In another embodiment according to any of the previous embodiments, a control device 70/81 controls a valve 72/74/83 associated with at least one of the of plurality of circumferentially spaced ones of the mixing bodies. The control selectively opens or closes the valve to either deliver fuel into the at least one of the plurality of circumferentially spaced ones of the mixing bodies, or block fuel flow into the one of the plurality of circumferentially spaced ones of the mixing bodies, such that there is a primary fuel supply and a secondary fuel supply with at least some of the plurality of circumferentially spaced ones of mixing bodies not receiving the fuel when the primary fuel supply is ongoing.

In another embodiment according to any of the previous embodiments, the mixing body includes two of the fuel supply passages each associated with a valve 72/74/83 controlled by a control 70/81, and one of the fuel supply passages being operated in conjunction with the associated valve as a primary fuel supply and a second of the two fuel supply passages being operated in conjunction with the associated valve as a secondary fuel supply.

In another embodiment according to any of the previous embodiments, one of the first and second fuel supply passages having its the mixing plenum radially spaced from the mixing plenum associated with another of the fuel supply passages relative to a central axis of the liner.

In another embodiment according to any of the previous embodiments, the cellular material is a metal.

In another embodiment according to any of the previous embodiments, the fuel is gaseous.

In another embodiment according to any of the previous embodiments, the fuel is gaseous.

In another embodiment according to any of the previous embodiments, the fuel supply passage is centered on a passage axis, and the inner face of the mixing body extending perpendicular to the passage axis.

In another embodiment according to any of the previous embodiments, the fuel supply passage is centered on a center axis, and some of the downstream extending passages closer to the center axis 40A extending for a lesser distance downstream of the mixing plenum than do others of the downstream extending passages 40B/40C spaced further from the center axis, such that the inner face of the mixing body is non-perpendicular to the center axis.

A gas turbine engine incorporating any of the above features is also disclosed and claimed.

Although embodiments have been disclosed, a worker of skill in this art would recognize that certain modifications would come within the scope of this disclosure. For that reason, the following claims should be studied to determine the true scope and content.

What is claimed is:

1. A combustor comprising:

a liner and an air fuel mixing body in a wall of said liner, a fuel supply passage to provide fuel into said mixing body, the fuel then being injected through radial distribution passages into a mixing plenum, a cellular material disposed in the mixing plenum;

air supply passages for delivering air into said mixing plenum;

downstream extending passages leading from said mixing plenum to an inner face of said mixing body for delivery of mixed fuel and air into a combustion chamber; and said fuel supply passage being a central fuel supply passage defining a center axis of said mixing body, the radial distribution passages extending in a direction having at least a component perpendicular to said center axis, and the radial distribution passages extending into the mixing plenum before the fuel begins mixing with air from the air supply passages.

2. The combustor as set forth in claim 1, wherein there are a plurality of circumferentially spaced ones of said mixing bodies.

3. The combustor as set forth in claim 2, wherein a control device configured to control a valve associated with at least one of said of plurality of circumferentially spaced ones of said mixing bodies, and the control selectively opening or closing said valve to either deliver fuel into said at least one of said plurality of circumferentially spaced ones of said mixing bodies, or block fuel flow into said one of said plurality of circumferentially spaced ones of said mixing bodies, such that there is a primary fuel supply and a secondary fuel supply with at least some of said plurality of circumferentially spaced ones of mixing bodies not receiving the secondary fuel supply when said primary fuel supply is ongoing.

4. The combustor as set forth in claim 1, wherein said mixing body including said fuel supply passage and a second fuel supply passage which is not on the center axis and each associated with a valve controlled by a control, and one of said fuel supply passages being operated in conjunction with said associated valve as a primary fuel supply and a second of said two fuel supply passages being operated in conjunction with said associated valve as a secondary fuel supply.

5. The combustor as set forth in claim 4, wherein there are plural mixing plenums, and one of said first and second fuel supply passages having its said mixing plenum radially spaced from said mixing plenum associated with another of said fuel supply passages relative to a central axis of the liner.

6. The combustor as set forth in claim 1, wherein the cellular material is a metal.

7. The combustor as set forth in claim 6, wherein the fuel is gaseous.

8. The combustor as set forth in claim 1, wherein the fuel is gaseous.

9. The combustor as set forth in claim 1, wherein said mixing body extending perpendicular to said center axis.

10. The combustor as set forth in claim 1, wherein some of said downstream extending passages closer to said center axis extending for a lesser distance downstream of said mixing plenum than do others of said downstream extending passages spaced further from said center axis, such that said inner face of said mixing body is non-perpendicular to said center axis.

11. A gas turbine engine comprising:

a compressor and a turbine section;

a combustor having a liner and an air fuel mixing body in a wall of said liner, a fuel supply passage to provide fuel into said mixing body, the fuel then being injected through radial distribution passages into a mixing plenum, a cellular material disposed in the mixing plenum;

air supply passages for delivering air into said mixing plenum;

downstream extending passages leading from said mixing plenum to an inner face of said mixing body for delivery of mixed fuel and air into a combustion chamber; and said fuel supply passage being a central fuel supply passage defining a center axis of said mixing body, the radial distribution passages extending in a direction having at least a component perpendicular to said center axis, and the radial distribution passages extending into the mixing plenum before the fuel begins mixing with air from the air supply passages.

12. The gas turbine engine as set forth in claim 11, wherein there are a plurality of circumferentially spaced ones of said mixing bodies.

13. The gas turbine engine as set forth in claim 12, wherein a control device configured to control a valve associated with at least one of said of plurality of circumferentially spaced ones of said mixing bodies, and the control selectively opening or closing said valve to either deliver fuel into said at least one of said plurality of circumferentially spaced ones of said mixing bodies, or block fuel flow into said one of said plurality of circumferentially spaced ones of said mixing bodies, such that there is a primary fuel supply and a secondary fuel supply with at least some of said plurality of circumferentially spaced ones of mixing bodies not receiving the secondary fuel supply when said primary fuel supply is ongoing.

14. The gas turbine engine as set forth in claim 11, wherein said mixing body including said fuel supply passage and a second fuel supply passage which is not on the center axis and each associated with a valve controlled by a control, and one of said fuel supply passages being operated in conjunction with said associated valve as a primary fuel supply and a second of said two fuel supply passages being operated in conjunction with said associated valve as a secondary fuel supply.

15. The gas turbine engine as set forth in claim 14, wherein there are plural mixing plenums, and one of said first and second fuel supply passages having its said mixing plenum radially spaced from said mixing plenum associated with another of said fuel supply passages relative to a central axis of the liner.

16. The gas turbine engine as set forth in claim 11, wherein the cellular material is a metal.

17. The gas turbine engine as set forth in claim 16, wherein the fuel is gaseous.

18. The gas turbine engine as set forth in claim 11, wherein the fuel is gaseous.

19. The gas turbine engine as set forth in claim 11, wherein said inner face of said mixing body extending perpendicular to said center axis.

20. The gas turbine engine as set forth in claim 11, wherein some of said downstream extending passages closer to said center axis extending for a lesser distance downstream of said mixing plenum than do others of said downstream extending passages spaced further from said passage axis, such that said inner face of said mixing body is non-perpendicular to said center axis.

* * * * *